US005857502A

United States Patent [19]

Buchalter

[11] Patent Number: 5,857,502

[45] Date of Patent: Jan. 12, 1999

[54] PACKAGING SYSTEM FOR CONCENTRATED MATERIALS

[75] Inventor: Gilbert Buchalter, Milburn, N.J.

[73] Assignee: Millburn Marketing Associates, Millburn, N.J.

[21] Appl. No.: 755,162

[22] Filed: Nov. 22, 1996

Related U.S. Application Data

[60] Provisional application No. 60/007,502, Nov. 22, 1995.

[51] Int. Cl. [6] ..... B65B 1/04

[52] U.S. Cl. ..... 141/100; 141/9; 141/2; 141/18

[58] Field of Search ..... 141/9, 100, 98, 141/2, 18, 110, 111, 112, 94, 95; 40/306, 310; 222/321.7, 321.9, 129, 23; 239/310, 145, 315, 326, 316; 206/459.1; 215/365; 53/474, 445, 239, 237, 136.1, 135.1

[56] References Cited

U.S. PATENT DOCUMENTS 3,659,395 5/1972 Morane et al. ..... 141/9
4,351,740 9/1982 Joshi et al. ..... 141/18
4,925,066 5/1990 Rosenbaum ..... 222/129
5,207,746 5/1993 Jones ..... 40/306
5,544,682 8/1996 McDaniel ..... 141/100

*Primary Examiner*—Steven O. Douglas
*Attorney, Agent, or Firm*—Lerner, David, Littenberg, Krumholz & Mentlik

[57] ABSTRACT

A packaging system for diluting a concentrated material to a preselected volume with a solvent for the concentrate, which system includes:

a container for the diluted concentrate having an internal volume to at least the predetermined volume;

an absorbent carrier disposed in the container; and a quantity of the concentrate absorbed onto the carrier;

wherein the quantity of concentrate is pre-measured to provide a predetermined level of dilution of the concentrate in the preselected volume of solvent. Methods for diluting a concentrate to a preselected volume with a solvent for the concentrate using the packaging system are also disclosed.

22 Claims, 1 Drawing Sheet

FIG.
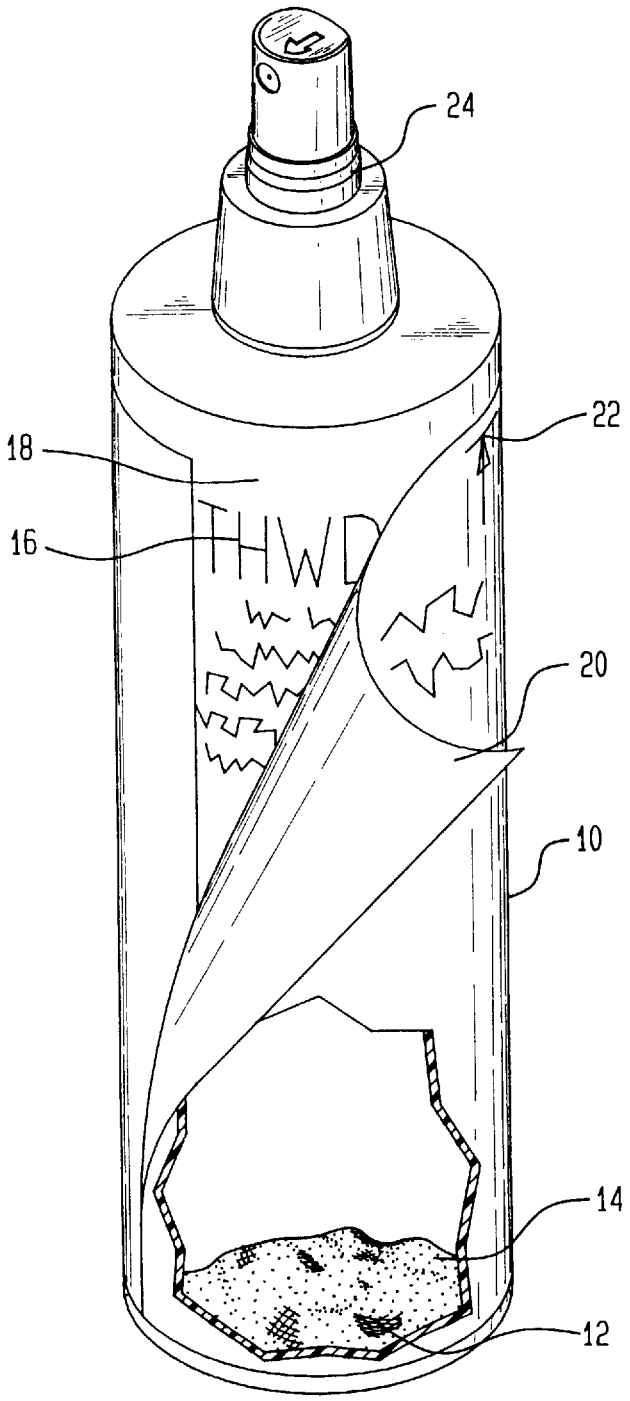

PACKAGING SYSTEM FOR CONCENTRATED MATERIALS

The present application claims benefit of U.S. Provisional Application Ser. No. 60/007,502, filed Nov. 22, 1995.

BACKGROUND OF THE INVENTION

The present invention relates to packaging systems for diluting concentrated materials to a preselected volume with a solvent for the concentrate in which a container for the diluted concentrate is packaged with a pre-measured quantity of the concentrate to be diluted, absorbed onto a carrier. The preselected volume of the solvent for the concentrate may then be added to the container with mixing to provide a predetermined level of dilution of the concentrate in the pre-selected volume of solvent. The present invention further relates to methods for diluting a concentrated material to a preselected volume with a solvent for the concentrate by disposing in a container for the diluted concentrate a pre-measured quantity of the concentrate absorbed on a carrier and then adding to the container the preselected volume of the solvent for the concentrate.

Many products are sold as liquid solutions consisting almost entirely of a solvent, such as water. A substantial reduction in shipping weight and consequential cost savings can be achieved by shipping the product in concentrated form essentially free of all, or nearly all, of the solvent.

Thus, a pre-measured quantity of a product concentrate may be added to a container for the final product to be diluted from the concentrate. The quantity of concentrated product and container size are selected so that a quantity of solvent for the concentrated product may be added to the container effective to dilute the concentrate to the desired strength of the final product. This is performed by the product consumer after shipment of the product and prior to use.

Products that are safe to use as dilute solutions may pose a chemical burn hazard to the skin and mucous membranes in concentrated form. This risk is posed, for example, by quaternary ammonium disinfectants. When a few milliliters of product concentrate are shipped in a container, there may or may not be a risk of chemical burns from concentrated product that may leak or spill out when opened or splash out of the container when water is added by the end-user to dilute the product to its final form. This hazard has prevented such products from being sold as concentrates in containers having sufficient internal volume to prepare the diluted final product by the addition of water. There remains a need for a safe means by which concentrated materials posing a hazard if splashed may be packaged in containers with a larger internal volume for dilution of the concentrate with solvent.

SUMMARY OF THE INVENTION

This need is met by the present invention. It has now been discovered that hazardous concentrates may be safely diluted by first adsorbing the concentrate on an absorbent material, which is then packaged in the container for the diluted concentrate for subsequent dilution with the solvent for the concentrate. The absorbent material allows the solvent to soak in and dissolve the concentrate, which is then released by the absorbent material.

Therefore, according to one embodiment of the present invention, a packaging system is provided for diluting a concentrate to a preselected volume with a solvent for the concentrate, which system includes:

a container for the diluted concentrate having an internal volume to at least the predetermined volume;

an absorbent carrier placed in the container; and a quantity of the concentrate absorbed onto the carrier;

wherein the quantity of concentrate is pre-measured to provide a predetermined level of dilution of the concentrate in the preselected volume of solvent.

In accordance with one aspect of this embodiment of the present invention, the container bears indicia, preferably permanently affixed, relating information concerning the final diluted concentrate, which is covered with a removable temporary label bearing information concerning the concentrate. A removable temporary label may also be affixed to or printed on the outside of the box of which said bottle is inside. Thus, the packaging system containing the concentrate is shipped bearing a label describing the concentrate. After the concentrate is diluted, the temporary label is removed to reveal information concerning the final diluted concentrate.

The foregoing labeling system is universally applicable to packaging systems for diluting concentrates, regardless of whether or not the concentrate is absorbed onto an absorbent carrier. Therefore, according to another embodiment of the present invention, a packaging system is provided for diluting a concentrate to a preselected volume with a solvent for the concentrate, which system includes:

a container for the diluted concentrate having an internal volume to at least the preselected volume, bearing indicia on the external surface thereof relating information concerning the diluted concentrate;

a quantity of the concentrate disposed in the container pre-measured to provide a predetermined level of dilution of the concentrate in the preselected volume of solvent; and a temporary removable label bearing information concerning the non-diluted concentrate and covering the information-relating indicia.

Another embodiment of the present invention provides methods for diluting a concentrate to a preselected volume with a solvent for the concentrate. Methods in accordance with this embodiment of the present invention include the steps of:

disposing in a container for the diluted concentrate having an internal volume to at least the preselected volume, an absorbent carrier having a quantity of the concentrate absorbed thereon, the quantity being pre-measured to provide a predetermined level of dilution of the concentrate in the preselected volume of solvent;

adding to the container the preselected volume of the solvent for the concentrate; and mixing the solvent and the concentrate so that a uniform homogeneous dilute solution of the concentrate in the solvent is obtained.

Methods in accordance with this embodiment of the present invention may also incorporate the above-discussed labeling system in which the external surface of the container bears indicia relating information concerning the diluted concentrate, which is covered with a temporary removable label bearing information concerning the non-diluted concentrate. In accordance with this aspect of the inventive method, the container is a container bearing indicia on the external surface thereof relating information concerning the diluted concentrate and further includes a temporary removable label bearing information concerning the non-diluted concentrate and covering the information-relating indicia and the method further includes the step of removing the temporary label to reveal the information-relating indicia concomitantly with the step of adding to the container the preselected volume of the solvent for the concentrate and mixing the solvent and the concentrate.

Because the labeling system of the present invention is universally applicable to packaging systems for diluting concentrates, methods in accordance with the present invention for diluting concentrates incorporating the labeling system need not require the concentrate to be absorbed on an absorbent carrier. Therefore, according to yet another embodiment of the present invention, a method is provided for diluting a concentrate to a preselected volume with a solvent for the concentrate. Methods in accordance with this embodiment of the present invention include the steps of:

disposing in a container for the diluted concentrate, having an internal volume to at least the preselected volume, a quantity of the concentrate pre-measured to provide a predetermined level of dilution of the concentrate in the preselected volume of solvent, wherein the container bears indicia on the external surface thereof relating information concerning the diluted concentrate and further includes a temporary removable label bearing information concerning the non-diluted concentrate and covering the information-relating indicia;

adding to the container the preselected volume of the solvent for the concentrate;

mixing the solvent and the concentrate so that a uniform homogeneous dilute solution of the concentrate in the solvent is obtained; and removing the temporary label to reveal the information-relating indicia concomitantly with the steps of adding to the container the preselected volume of the solvent and mixing the solvent and the concentrate.

The packaging systems and methods of the present invention are not limited to the packaging and dilution of hazardous concentrated materials, but instead are useful in the packaging and dilution of essentially any material that may be shipped as a concentrate. In addition to solving the problems related to hazardous concentrates, the present invention also provides a method by which concentrated materials may be uniformly and accurately dispensed and packaged for subsequent dilution. Other features of the present invention will be pointed out in the following description and claims, which disclose the principles of the invention and the best modes which are presently contemplated for carrying them out.

BRIEF DESCRIPTION OF THE DRAWING

A more complete appreciation of the invention and many more other intended advantages can be readily obtained by reference to the detailed description of the invention when considered in connection with the single FIGURE, which shows a diagrammatic perspective view of a device according to the present invention.

It should be noted that the drawing is not necessarily to scale, but that certain elements have been expanded to show more clearly the various aspects of the present invention and their advantages.

DETAILED DESCRIPTION OF THE PREFERRED EMBODIMENT

The device in accordance with the present invention is shown in FIG. 1 in which absorbent material 12 is disposed in container 10 with a concentrated material 14 absorbed thereon. Container 10 bears indicia 16 on the external surface 18 thereof. The indicia 16 relates information concerning the concentrated material 14 in its final, diluted form. The external surface 18 of container 10 has a temporary removable label 20 affixed thereto, covering the indicia 16. Fill line 22 on the temporary label indicates the amount of solvent to be added to dilute the concentrated material 14 to its final strength. A similar fill line may also be provided on the external surface 18 of container 10 (not shown). The container 10 is also provided with a spraying means 24 for delivering the final diluted product. However, essentially any conventional delivery means may be employed.

Container 10 has an internal volume of at least the volume required for the final diluted concentrated material. It is preferred that some air space remain in the container to allow for more efficient mixing of concentrate and solvent.

Essentially any container suitable for dispensing a diluted product may be used with the present invention. Suitable materials include, but are not limited to, glass, ceramic, metal and a plastic such as polyethylene, polypropylene, polyester, polystyrene, polyvinyl chloride, and the like. The container volume may be selected to conform to the size of container in which the diluted product is customarily sold.

The absorbent material may be any material possessing capillary and/or absorbent activity with respect to the solvent to be used that does not degrade or fall apart in the solvent. The amount of absorbent material to be used is at least that amount effective to soak up the pre-measured quantity of concentrated material. Examples of suitable absorbent materials include cotton or synthetic gauze, non-woven materials, natural or synthetic sponge, paper, and the like. It is also contemplated that the concentrated material be retained in a proteinaceous or polymeric gel matrix, and for purposes of the present invention, the absorbent material is defined as including such gel matrices. Proteinaceous gel materials include agar and gelatin, while polymeric gel materials include polyalkylene oxides such as polyethylene glycol.

The solvent to be employed may or may not be the solvent used in the diluted form of the product that is customarily marketed. Depending on the product, the solvent may be water, and alcohol such as methanol, ethanol, isopropanol, and the like, petroleum products and derivatives.

In the embodiment depicted in FIG. 1, two ml of a concentrated mixture of quaternary ammonium salts 14, useful in dilute form as a disinfectant, are adsorbed onto absorbent material 12, optionally with perfume, color, etc., according to the art. The quantity of the concentrated material is pre-measured to provide a predetermined level of dilution of the material in the volume of solvent to be used in the container. Larger containers will contain larger quantities of solvent that will require greater amounts of the concentrated material to achieve the desired level of dilution.

Other concentrated materials suitable for use with the present invention include, but are not limited to, electrolyte spray, antibiotic solutions, perfumes, inks and body lotions.

The indicia 16 on the external surface 18 of container 10 are preferably permanently affixed. The indicia may be silk screened on the container surface, applied in the form of a label, or by essentially any well-known conventional technique. This functions as an inner label identifying the diluted material, together with use instructions, appropriate cautions, and information concerning storage and disposal. Information complying with regulatory requirements may also be included.

The temporary label 20 covering indicia 16 on the external surface 18 of container 10 is essentially conventional to the art of temporary labeling. The labels used with the containers of the present invention are prepared from conventional label stock and printed by conventional techniques. Likewise, direct silk screening of containers, when employed, is also be essentially conventional techniques. The temporary label 20 may be laminated or spot-welded with a removable adhesive. The temporary label may also be affixed to portions of container 10 with a permanent adhesive and contain perforations that permit the removal of the portion of the label covering the indicia on the surface of the container. Essentially any conventional technique for affixing a temporary label to a container may be employed.

The devices of the present invention are prepared by absorbing or adsorbing the pre-measured quantity of the concentrated material onto the absorbent material, which is then placed inside an appropriate labeled container. The container is then sealed and packaged for shipment to the consumer.

The consumer then prepares the final diluted product by adding the solvent to be employed, typically, but not limited to water, to the fill line of the container, which reflects the volume of solvent providing the desired level of dilution of the concentrated material for the pre-measured quantity of concentrated material employed. The container is then shaken to mix the solvent and concentrate to form a uniform homogeneous solution. Concomitantly with the addition of solvent and mixing, the temporary label is removed to reveal the indicia on the surface of the container relating information about the final diluted product. This may be performed before the solvent is added, after the product is mixed, or any time during the solvent addition and mixing process. It is preferred that the label not be removed either too far before the solvent is added or too long after the solvent and concentrate are mixed, to insure that the label visible on the surface of the container accurately reflects the container contents.

The dual label system of the present invention may also be employed with prior art packaging systems in which the concentrated material in the container is not adsorbed onto an absorbent material. Likewise, the combination of the absorbent material having a concentrated material absorbed thereto may be disposed in a container having a single label. The single label may contain only information concerning the final diluted product, or it may also contain information concerning the concentrated material.

For purposes of the present invention, the term "concentrated material" refers to materials to be diluted in their essentially pure form, or in the form of a low solvent concentration, in which the solvent is the same solvent to be added by the consumer, or a different solvent in which the material is soluble. Although the packaging system of the present invention was developed for use with materials that posed a chemical burn hazard in their concentrated form, non-hazardous concentrated materials may also be employed. The packaging system of the present invention provides a means by which such non-hazardous concentrated materials may be uniformly and accurate dispensed and packaged for subsequent dilution.

Significantly, however, the present invention permits the safe and convenient dilution of hazardous or non-hazardous concentrated materials, thereby permitting such materials to be shipped in concentrated form in containers with a larger internal volume for dilution of the concentrated material with solvent without the risk of leaking. It is now possible for consumers to safely and conveniently dilute the concentrated material without the risk of receiving chemical burns from splashing of the material. The present invention also provides a convenient means by which information may be related to the consumer concerning the product in both its concentrated and final, diluted form.

As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

What is claimed is:

1. A packaging system for diluting a concentrate to a preselected volume with a solvent for said concentrate, comprising:

(a) a container for diluting said concentrate having an internal volume to at least said preselected volume;

(b) an absorbent carrier disposed in said container; and (c) a quantity of said concentrate absorbed onto said carrier;

(d) wherein said quantity of concentrate is pre-measured to provide a predetermined level of dilution of said concentrate when said solvent is added to said container to said preselected volume.

2. The packaging system of claim 1, wherein said container bears indicia on the external surface thereof relating information concerning the diluted concentrate and further includes a temporary removable container label or labeled box bearing information concerning the non-diluted concentrate and covering said indicia.

3. The packaging system of claim 2, wherein said indicia are permanently affixed to said external surface of said container.

4. The packaging system of claim 1, wherein said concentrate is a quaternary ammonium salt disinfectant.

5. The packaging system of claim 1, wherein said absorbent carrier comprises a material selected from the group consisting of cotton and synthetic gauzes, non-woven materials, natural and synthetic sponges and paper.

6. A packaging system for diluting a concentrate to a preselected volume with a solvent for said concentrate, comprising:

(a) a container for diluting said concentrate having an internal volume to at least said preselected volume and bearing indicia on the external surface thereof relating information concerning said diluted concentrate;

(b) a quantity of said concentrate disposed in said container pre-measured to provide a predetermined level of dilution of said concentrate when said solvent is added to said container to said preselected volume; and (c) a temporary removable container label or labeled box bearing information concerning said non-diluted concentrate and covering said indicia.

7. The packaging system of claim 6, wherein said indicia are permanently affixed to said external surface of said container.

8. The packaging system of claim 6, wherein said concentrate is absorbed onto an absorbent carrier comprising a material selected from the group consisting of cotton and synthetic gauze, non-woven materials, natural and synthetic sponges and paper.

9. The packaging system of claim 8, wherein said concentrate is a quaternary ammonium salt disinfectant.

10. A method for diluting a concentrate to a preselected volume with a solvent for said concentrate comprising the steps of:

(a) disposing in a container for diluting said concentrate, having an internal volume to at least said preselected volume, an absorbent carrier having a quantity of said concentrate absorbed thereon, said quantity being pre-measured to provide a predetermined level of dilution of said concentrate when said solvent is added to said container to said preselected volume;

(b) adding said solvent to said container to said preselected volume; and (c) mixing said solvent and said concentrate so that a uniform, homogenous dilute solution of said concentrate in said solvent is obtained.

11. The method of claim 10, wherein said container is a container bearing indicia on the external surface thereof relating information concerning said diluted concentrate and further includes a temporary removable container label or labeled box bearing information concerning the non-diluted concentrate and covering said indicia, and said method further includes the step of removing said temporary container label or labeled box to reveal said indicia concomitantly with said steps of adding to said container said preselected volume of said solvent and mixing said solvent and said concentrate.

12. The method of claim 11, wherein said indicia are permanently affixed to said external surface of said container.

13. The method of claim 10, wherein said concentrate is a quaternary ammonium salt disinfectant.

14. The method of claim 10, wherein said absorbent carrier comprises a material selected from the group consisting of cotton and synthetic gauzes, non-woven materials, natural and synthetic sponges and paper.

15. The method of claim 10, wherein said solvent comprises water, one or more alcohols, or a mixture of water with one or more alcohols.

16. A method for diluting a concentrate to a preselected volume with a solvent for said concentrate comprising the steps of:

(a) disposing in a container for diluting said concentrate, having an internal volume to at least said preselected volume, a quantity of said concentrate pre-measured to provide a predetermined level of dilution of said concentrate when said solvent is added to said container to said preselected volume, wherein said container bears indicia on the external surface thereof relating information concerning said diluted concentrate and further includes a temporary removable container label or labeled box bearing information concerning said non-diluted concentrate and covering said indicia; and (b) adding to said container said solvent to said preselected volume;

(c) mixing said solvent and said concentrate so that a uniform, homogenous dilute solution of said concentrate in said solvent is obtained; and (d) removing said temporary container label or labeled box to reveal said indicia concomitantly with said steps of adding said solvent to said container and mixing said solvent and said concentrate.

17. The method of claim 16, wherein said concentrate is absorbed on an absorbent carrier comprising a material selected from the group consisting of synthetic and cotton gauzes, non-woven materials, natural and synthetic sponges and paper.

18. The method of claim 17, wherein said concentrate is a quaternary ammonium salt disinfectant.

19. The method of claim 16, wherein said indicia are permanently affixed to said external surface of said container.

20. The method of claim 16, wherein said solvent comprises water, one or more alcohols, or a mixture of water with one or more alcohols.

21. A packaging system for diluting a concentrated quaternary ammonium salt disinfectant to a preselected volume with a solvent for said disinfectant, comprising:

(a) a container for diluting said disinfectant having an internal volume to at least said preselected volume;

(b) an absorbent carrier disposed in said container;

(c) a quantity of said disinfectant absorbed onto said container;

(d) wherein said quantity of disinfectant is pre-measured to provide a predetermined level of dilution of said disinfectant when said solvent is added to said container to said preselected volume.

22. A packaging system for diluting a concentrated quaternary ammonium salt disinfectant to a preselected volume with a solvent for said disinfectant, comprising:

(a) a container for diluting said disinfectant having an internal volume to at least said preselected volume and bearing indicia on the external surface thereof relating information concerning said diluted disinfectant;

(b) a quantity of said disinfectant disposed in said container pre-measured to provide a predetermined level of the dilution of said disinfectant when said solvent is added to said container to said preselected volume; and (c) a temporary removable container label or labeled box bearing information concerning said non-diluted disinfectant and covering said indicia.

* * * * *